US011174699B2

(12) United States Patent
Purohit et al.

(10) Patent No.: US 11,174,699 B2
(45) Date of Patent: Nov. 16, 2021

(54) DOWNHOLE PACKER RING APPARATUS AND METHOD OF ASSEMBLING THEREOF

(71) Applicant: Halliburton Energy Services, Inc., Houston, TX (US)

(72) Inventors: Ankit Purohit, Singapore (SG); Geir Gjelstad, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 16/623,857

(22) PCT Filed: Jul. 31, 2017

(86) PCT No.: PCT/US2017/044642
§ 371 (c)(1),
(2) Date: Dec. 18, 2019

(87) PCT Pub. No.: WO2019/027413
PCT Pub. Date: Feb. 7, 2019

(65) Prior Publication Data
US 2020/0141206 A1 May 7, 2020

(51) Int. Cl.
*E21B 33/12* (2006.01)
*E21B 33/127* (2006.01)

(52) U.S. Cl.
CPC ..... *E21B 33/1208* (2013.01); *E21B 33/12* (2013.01); *E21B 33/127* (2013.01)

(58) Field of Classification Search
CPC . F16L 37/098; F16L 37/0927; F16L 37/0925; E21B 33/12; E21B 33/127
See application file for complete search history.

(56) References Cited

U.S. PATENT DOCUMENTS

| | | | | |
|---|---|---|---|---|
| 4,457,369 | A * | 7/1984 | Henderson | E21B 33/1293 166/125 |
| 9,175,533 | B2 * | 11/2015 | Standridge | E21B 33/129 |
| 2002/0043368 | A1 | 4/2002 | Bell et al. | |
| 2010/0171302 | A1 | 7/2010 | Yoder | |
| 2013/0306330 | A1 | 11/2013 | Bishop et al. | |
| 2015/0159794 | A1 | 6/2015 | Bobo et al. | |
| 2015/0308214 | A1 | 10/2015 | Bilansky et al. | |
| 2016/0090813 | A1 | 3/2016 | Conner et al. | |

FOREIGN PATENT DOCUMENTS

| | | | |
|---|---|---|---|
| WO | 2008062186 | A1 | 5/2008 |
| WO | 2010019819 | A1 | 2/2010 |
| WO | 2012045168 | A1 | 4/2012 |
| WO | 2019027413 | A1 | 2/2019 |

* cited by examiner

*Primary Examiner* — Yong-Suk (Philip) Ro
(74) *Attorney, Agent, or Firm* — Scott Richardson; Parker Justiss, P.C.

(57) ABSTRACT

A downhole packer ring apparatus for use in a wellbore, comprising a first ring member and a second ring member. The first ring member has an end with a plurality of separated end tabs. The first ring member has an opening with an inner diameter sized to encircle a basepipe of the wellbore. The second ring member has a tapered interior surface and an end with an opening having an inner diameter sized to encircle the basepipe and connect to the first ring member such that the end tabs of the first ring member are locatable in the end opening of the second ring member and pressable against the tapered interior surface such that flexed portions of the end tabs engage with the basepipe.

20 Claims, 14 Drawing Sheets

DOWNHOLE PACKER RING APPARATUS AND METHOD OF ASSEMBLING THEREOF

CROSS-REFERENCE TO RELATED APPLICATION

This application is the National Stage of, and therefore claims the benefit of, International Application No. PCT/US2017/044642 filed on Jul. 31, 2017, entitled "DOWNHOLE PACKER RING APPARATUS AND METHOD OF ASSEMBLING THEREOF," which was published in English under International Publication Number WO 2019/027413 on Feb. 7, 2019. The above application is commonly assigned with this National Stage application and is incorporated herein by reference in its entirety.

BACKGROUND

Swell packers are well-known downhole isolation tools that include one or more rubber elements and packer rings. The rubber elements are either bonded to or slipped around a basepipe of the wellbore, and the packer rings are located adjacent to ends of the rubber element and fastened around the basepipe. The rings help to prevent the rubber elements from sliding along the basepipe and to facilitate the rubber elements to swell out radially from the basepipe to seal off the wellbore annulus either toward the casing or the open hole and withstand differential pressures in the well bore. Since any one well can include tens or hundreds of such rings, it is desirable to mount the rings around the base pipe in an expeditious and economical manner.

BRIEF DESCRIPTION

Figure 1:
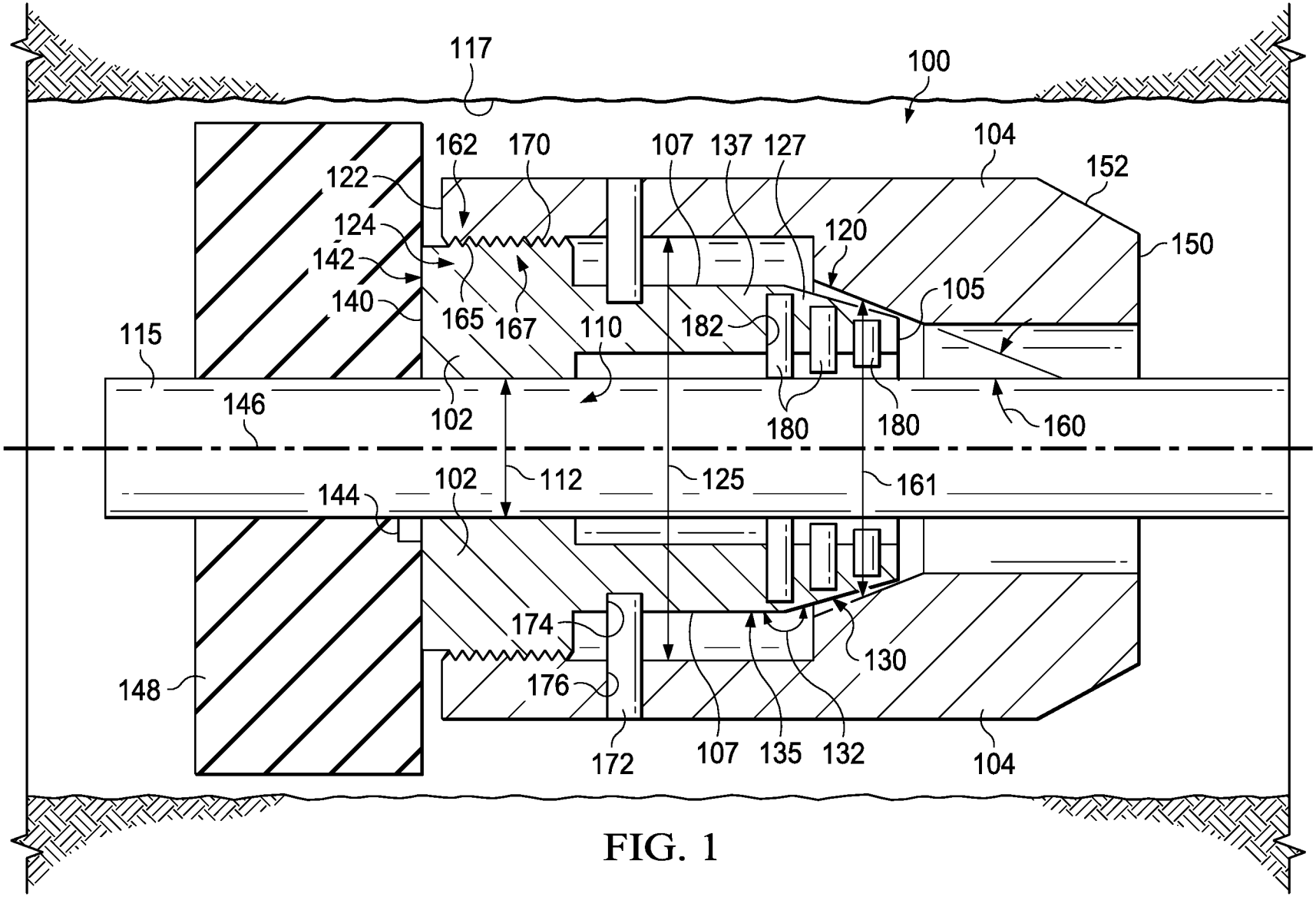
Figure 2:
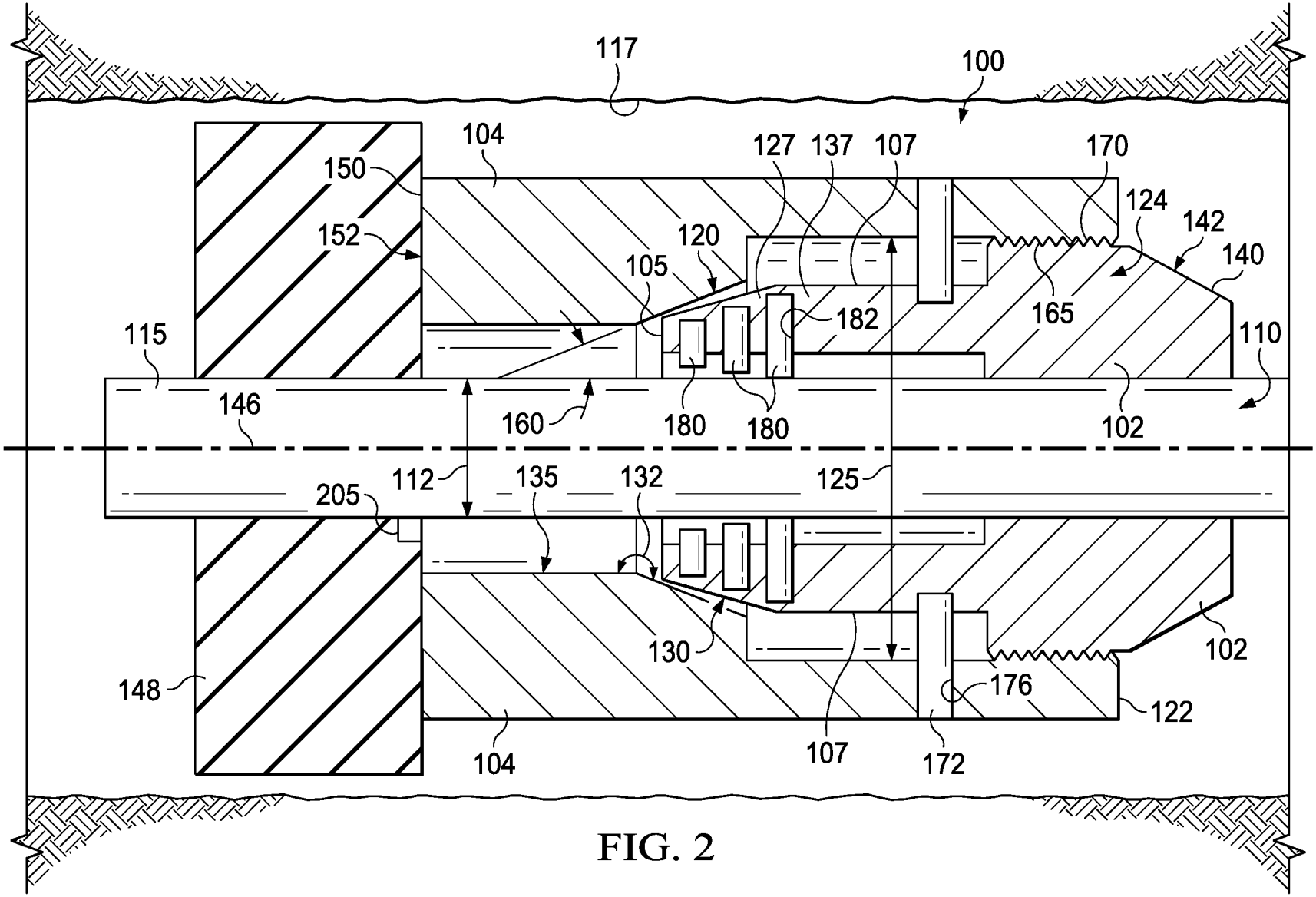
Figure 3:
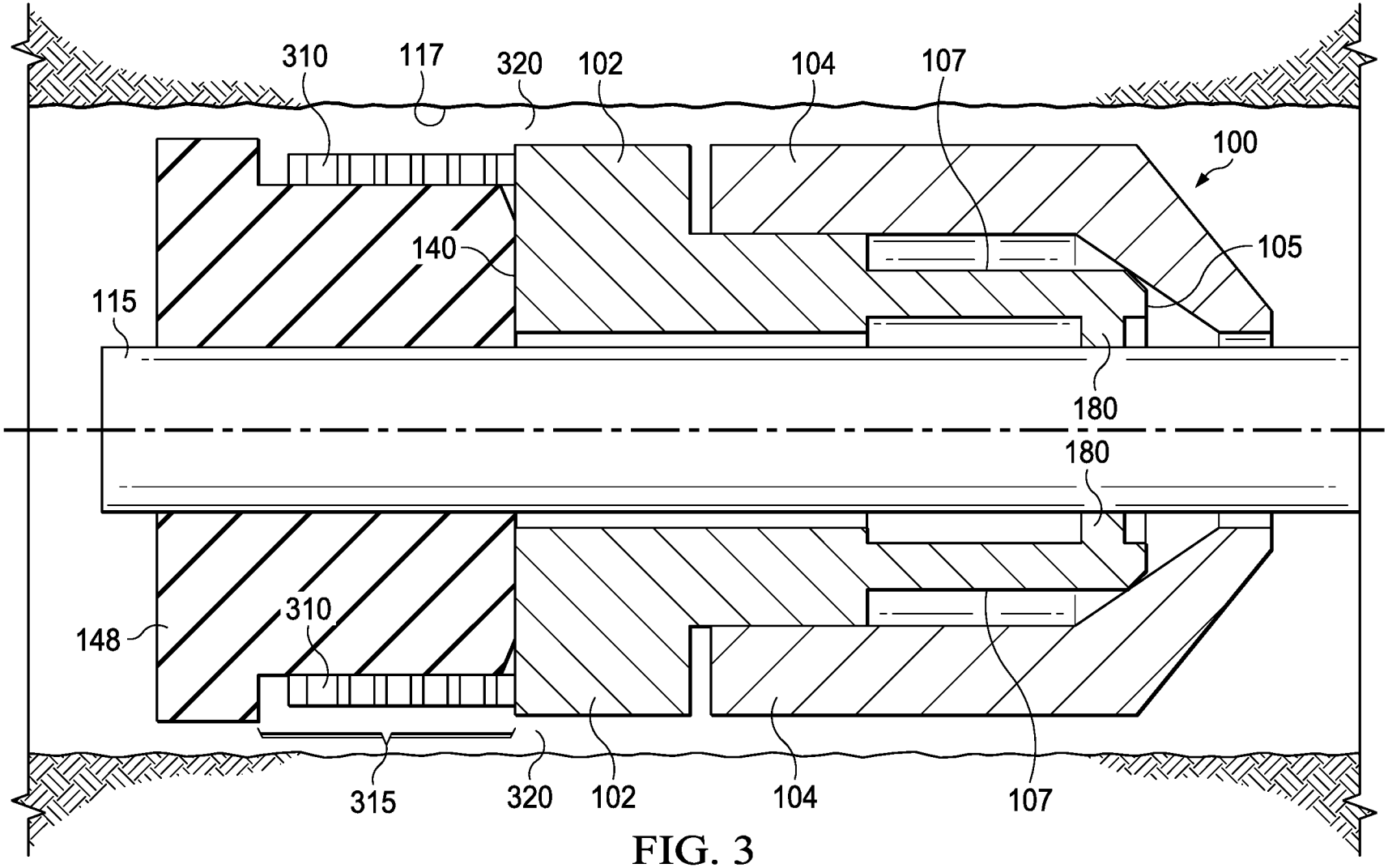
Figure 4:
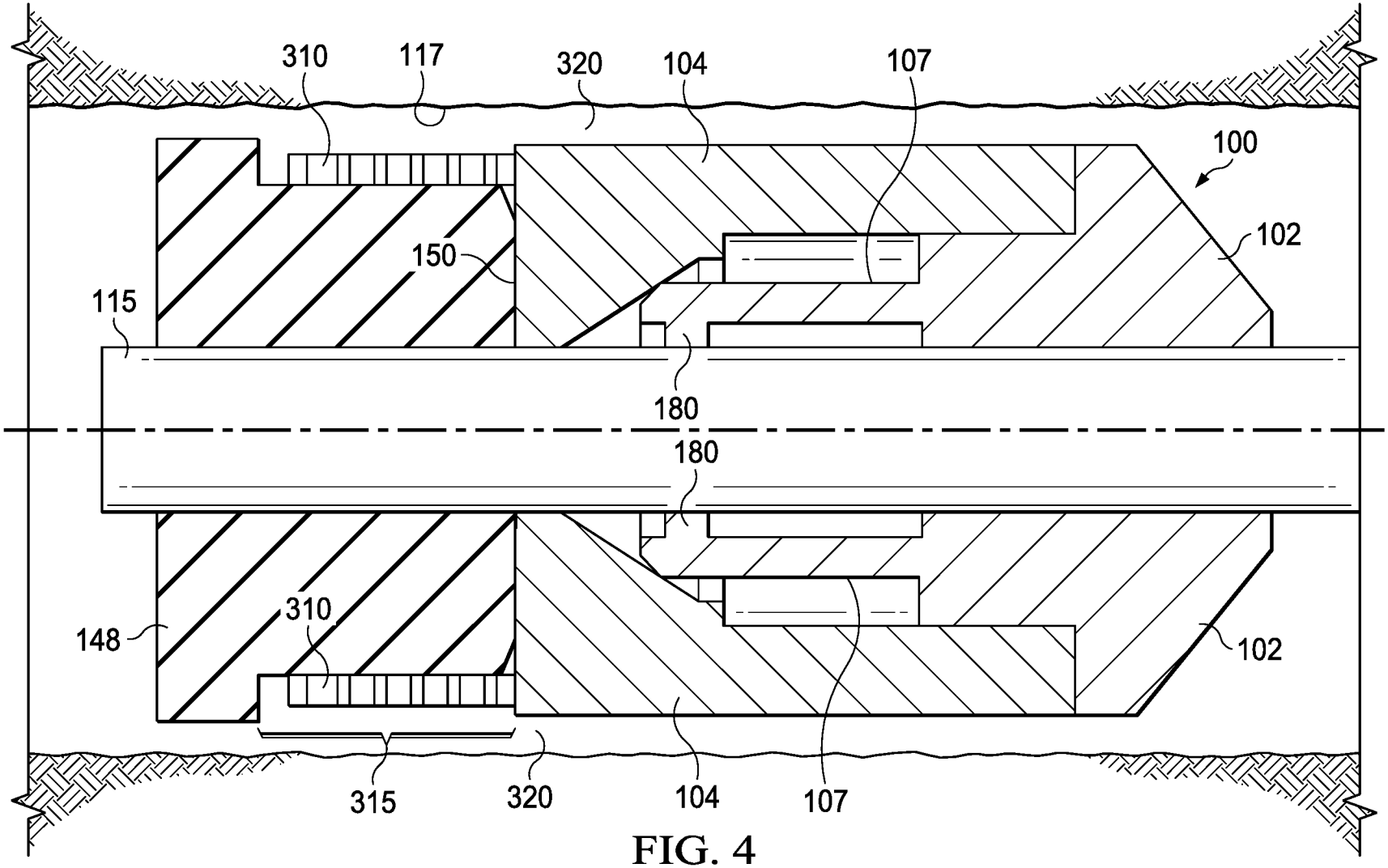
Figure 5:
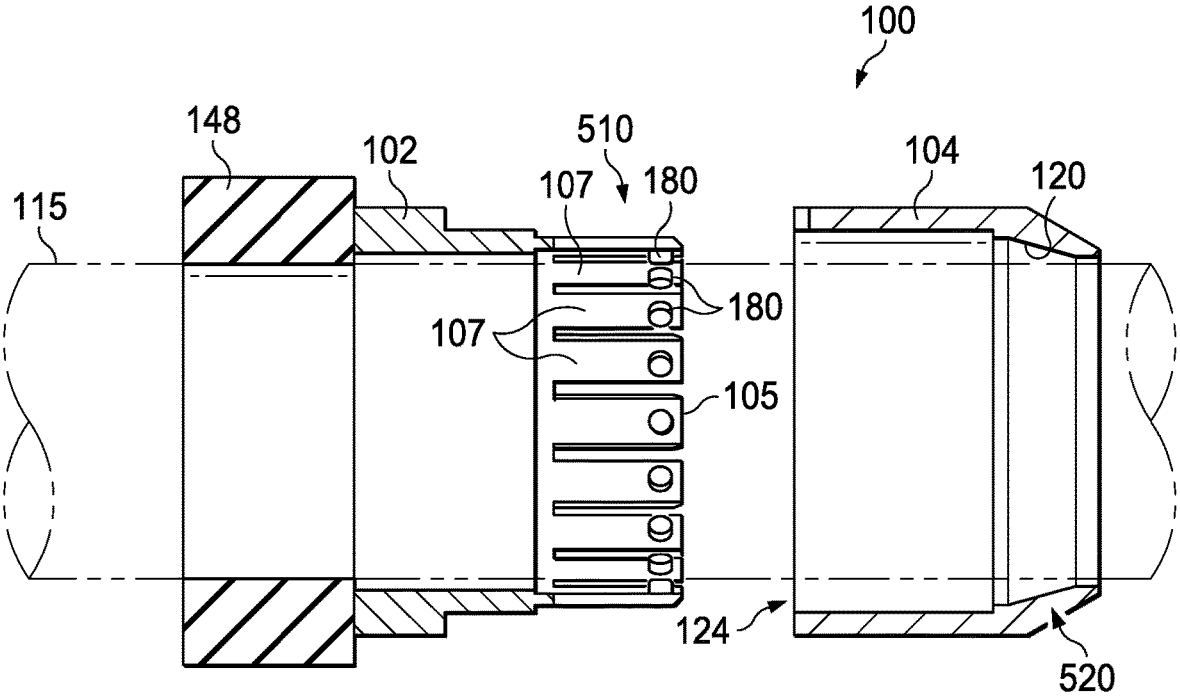
Figure 6:
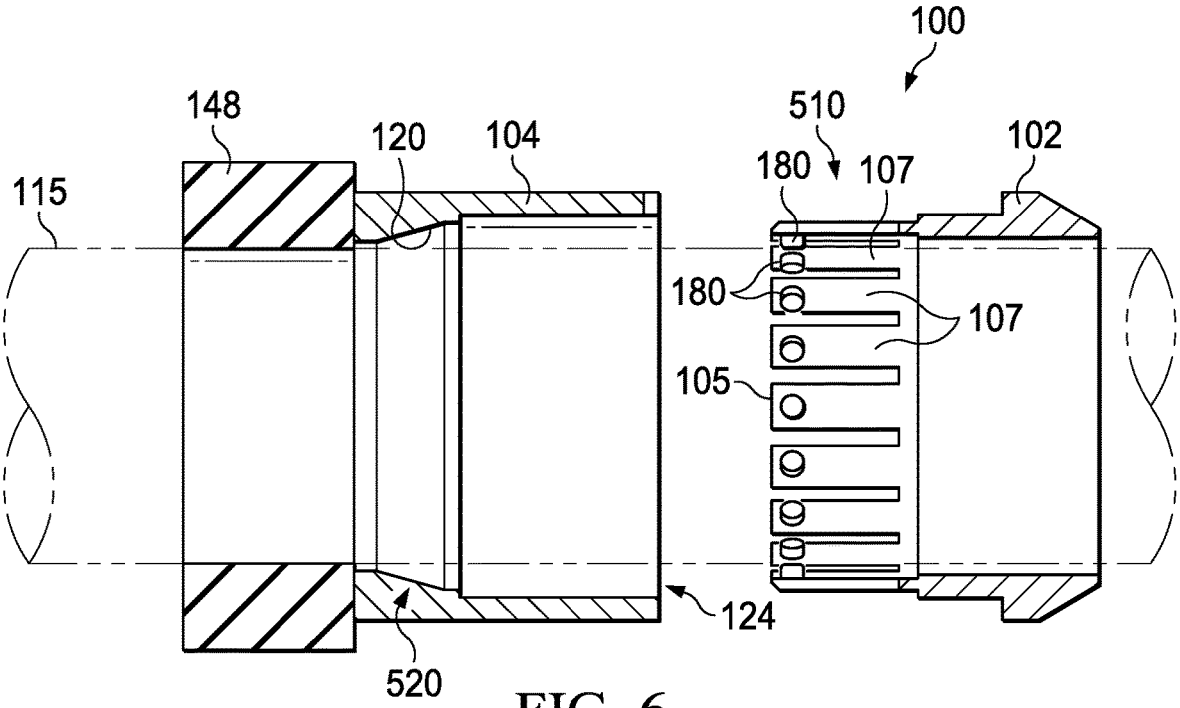
Figure 7:
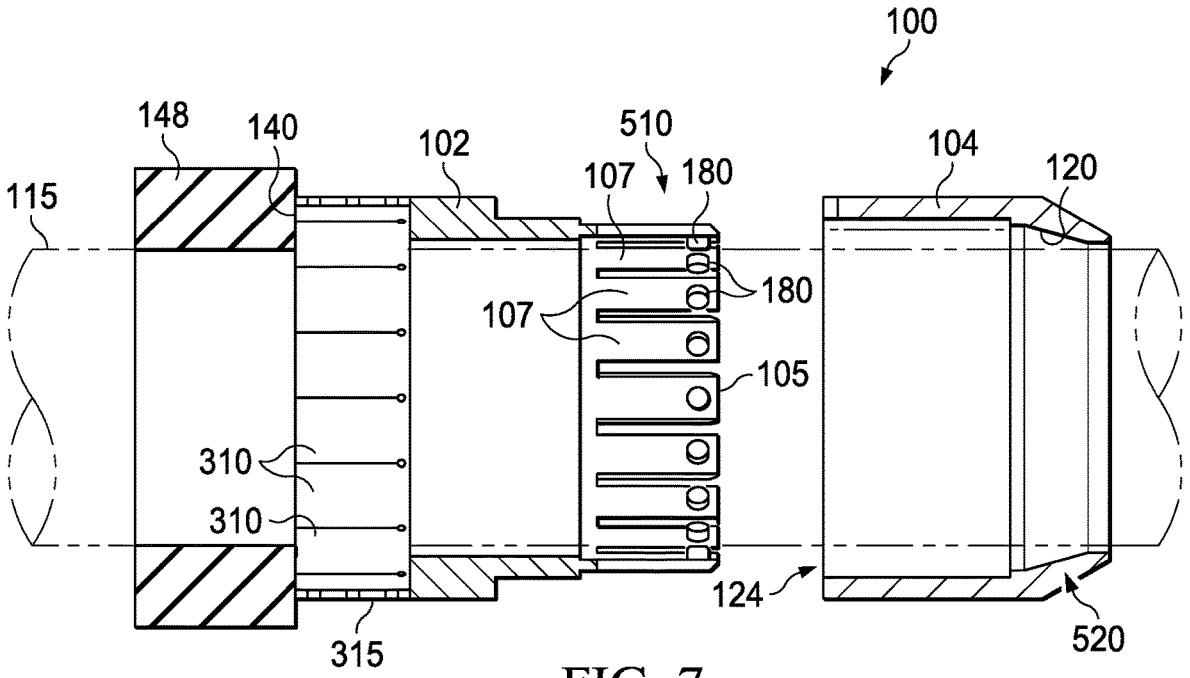
Figure 8:
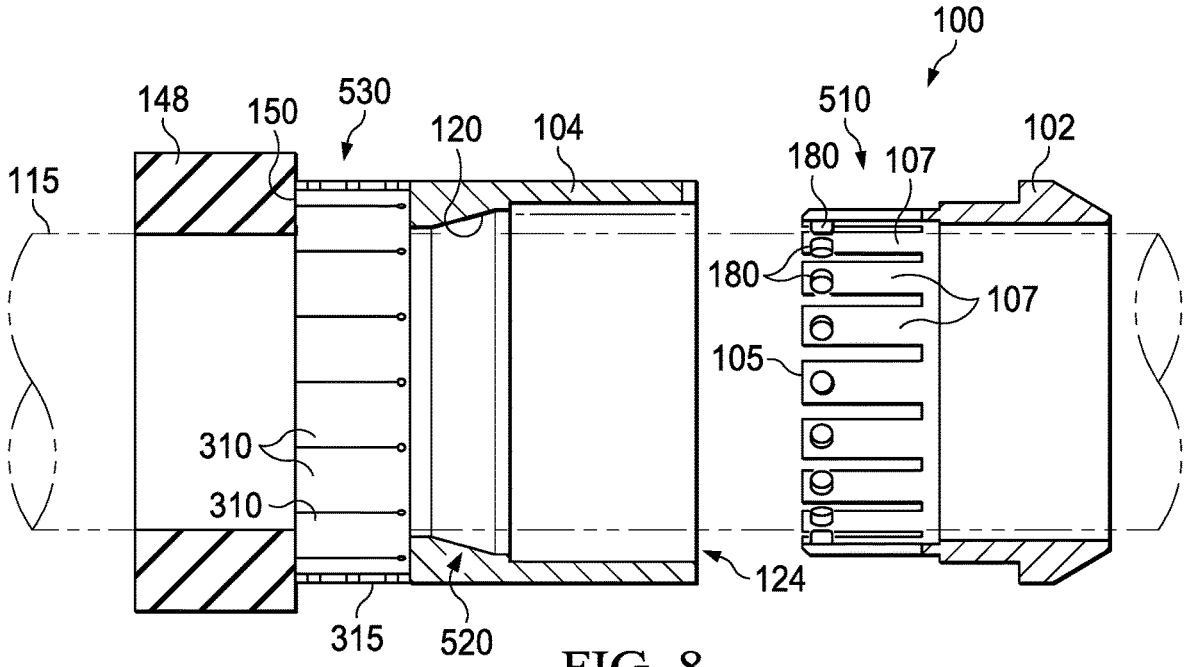
Figure 9A:
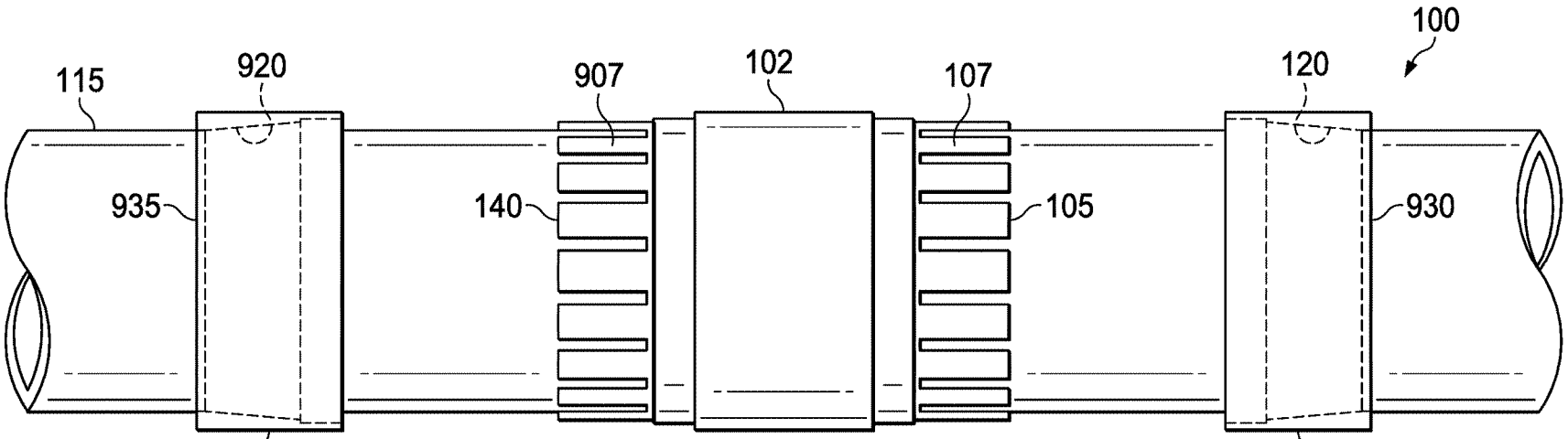
Figure 9B:
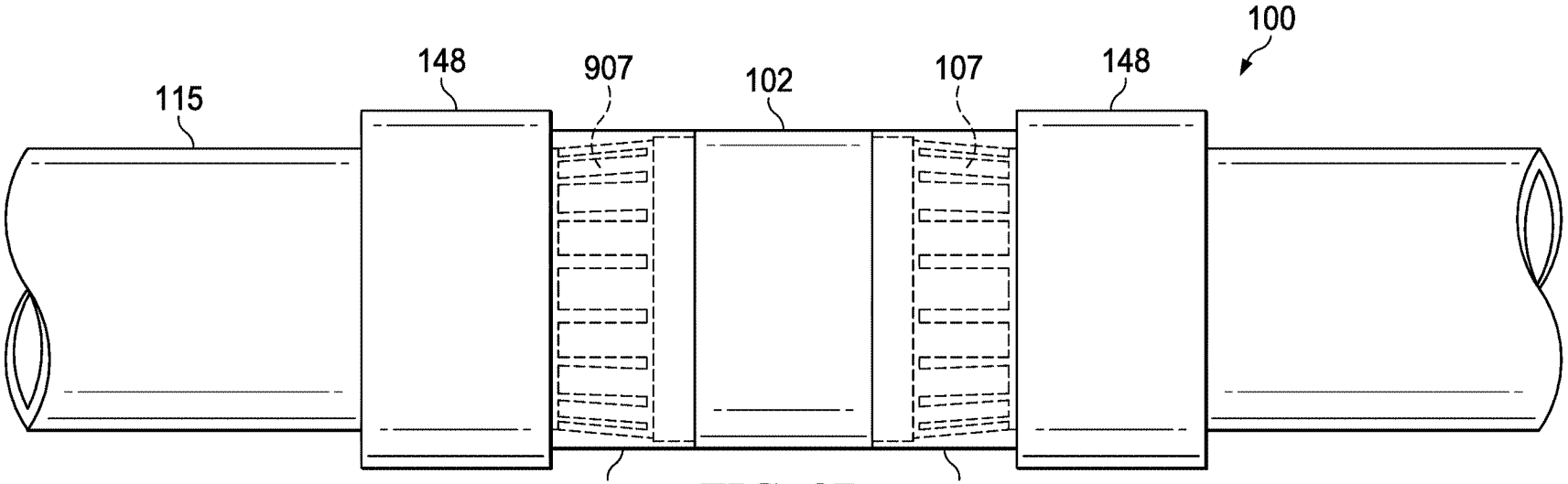
Figure 10A:
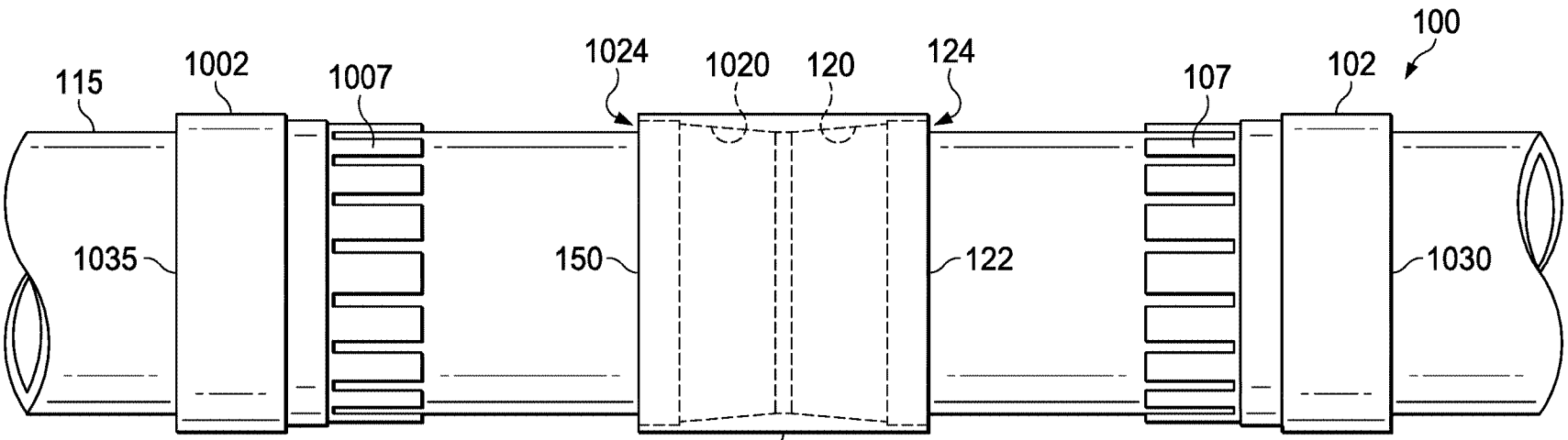
Figure 10B:
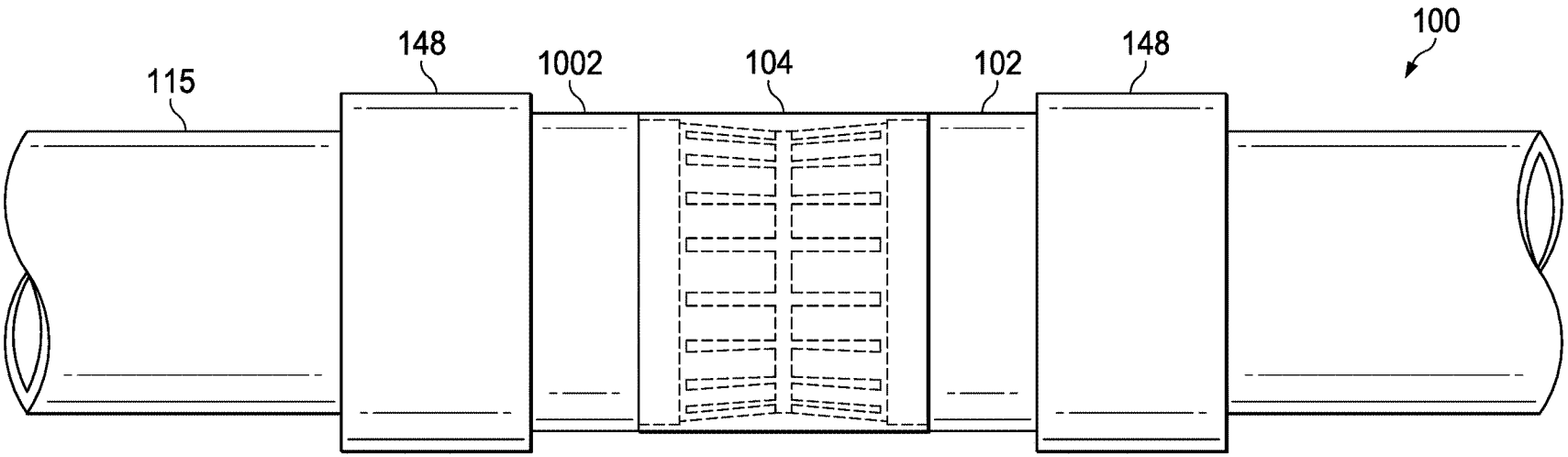
Figure 12A:
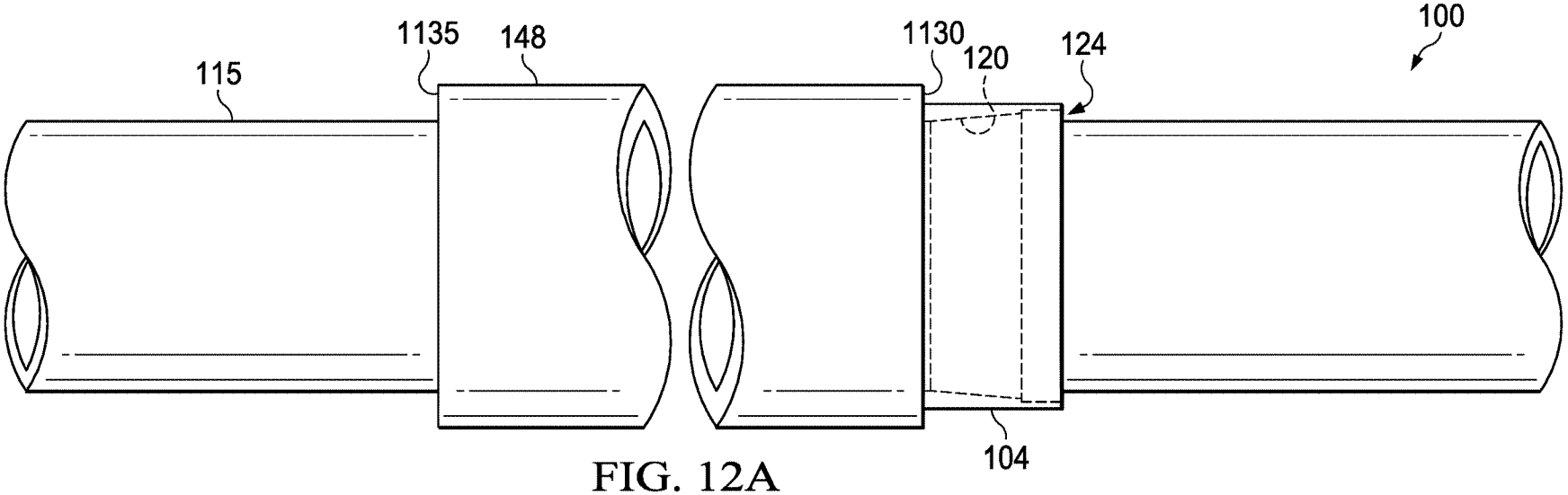
Figure 12B:
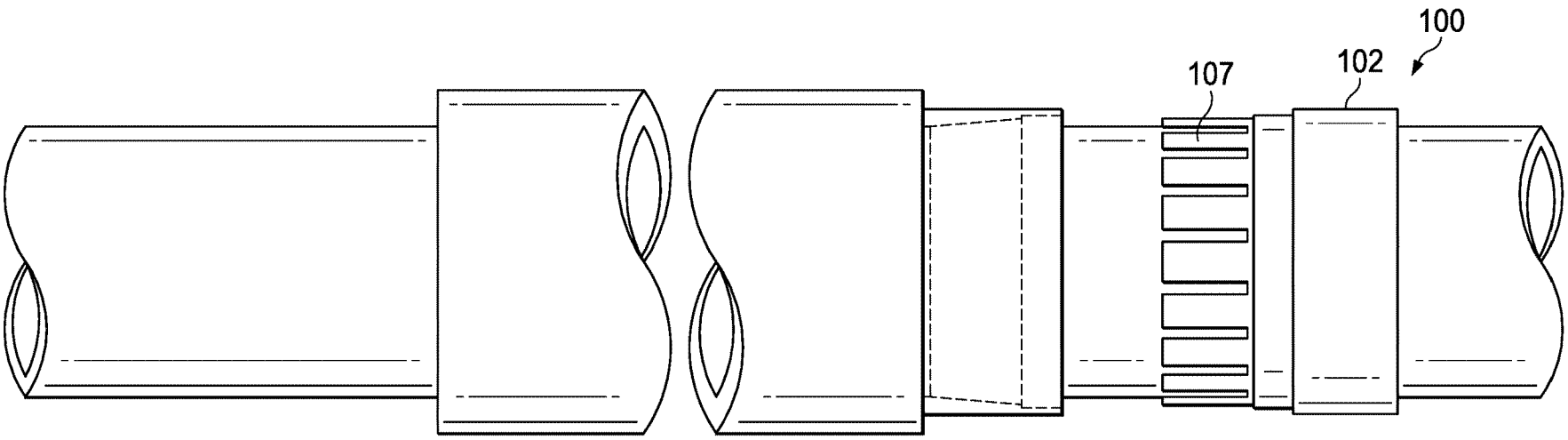
Figure 12C:
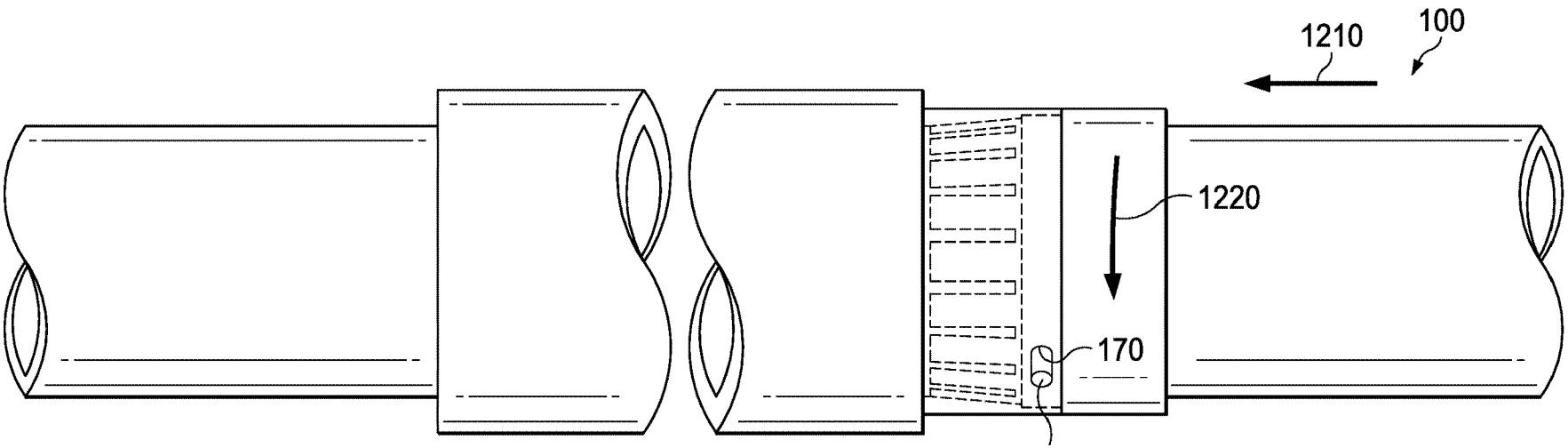
Figure 12D:
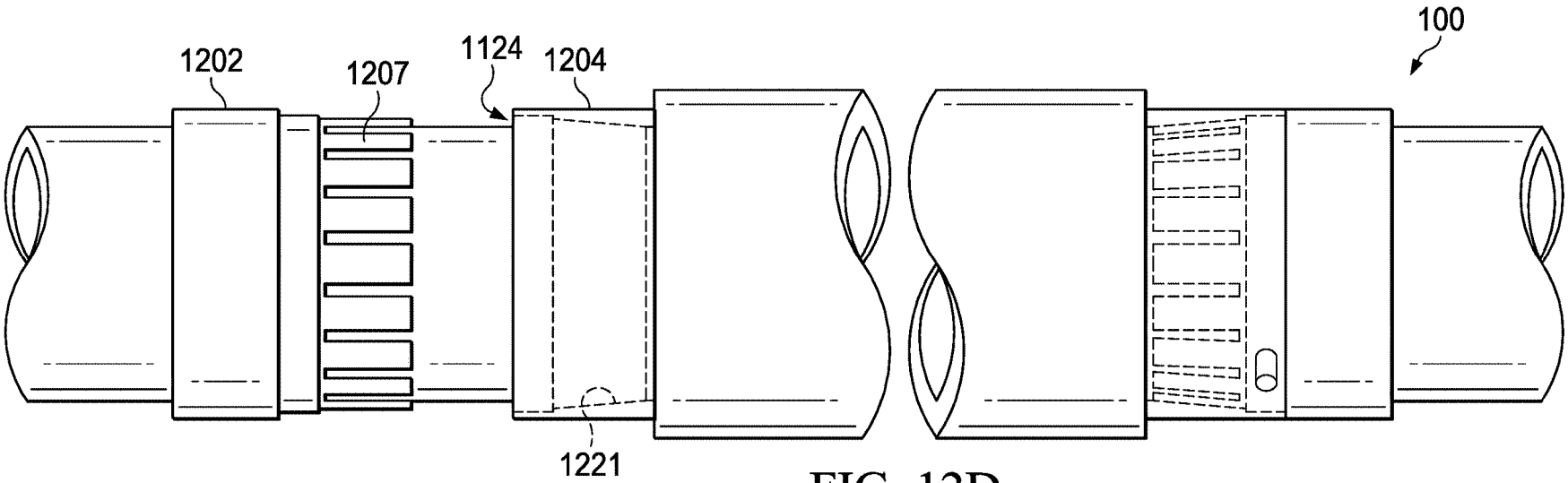
Figure 12E:
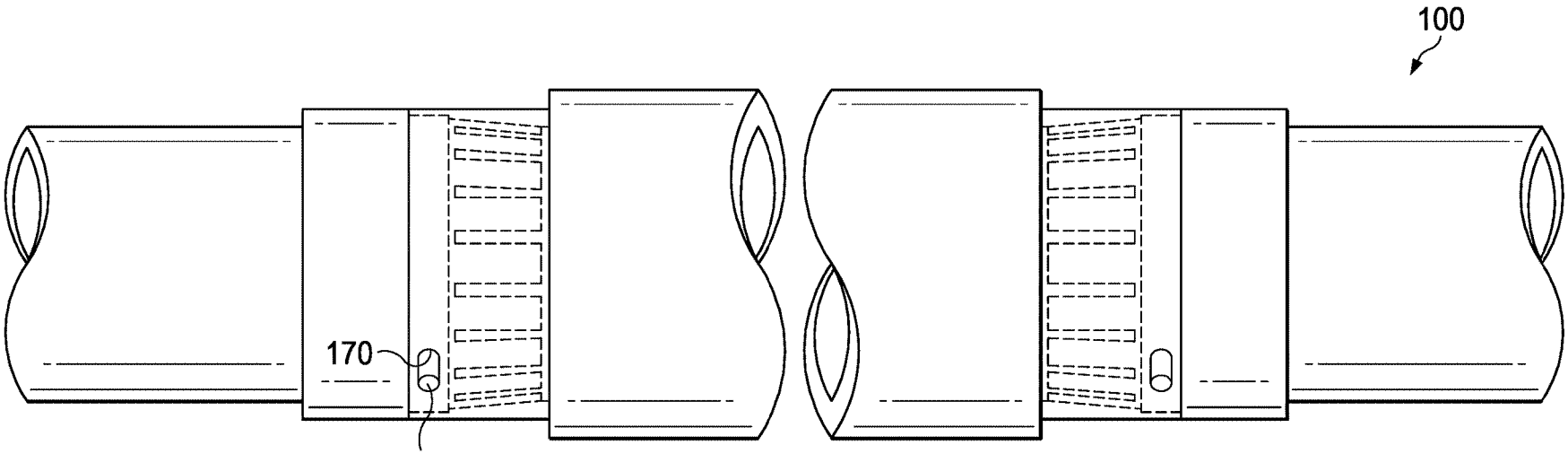
Figure 13:
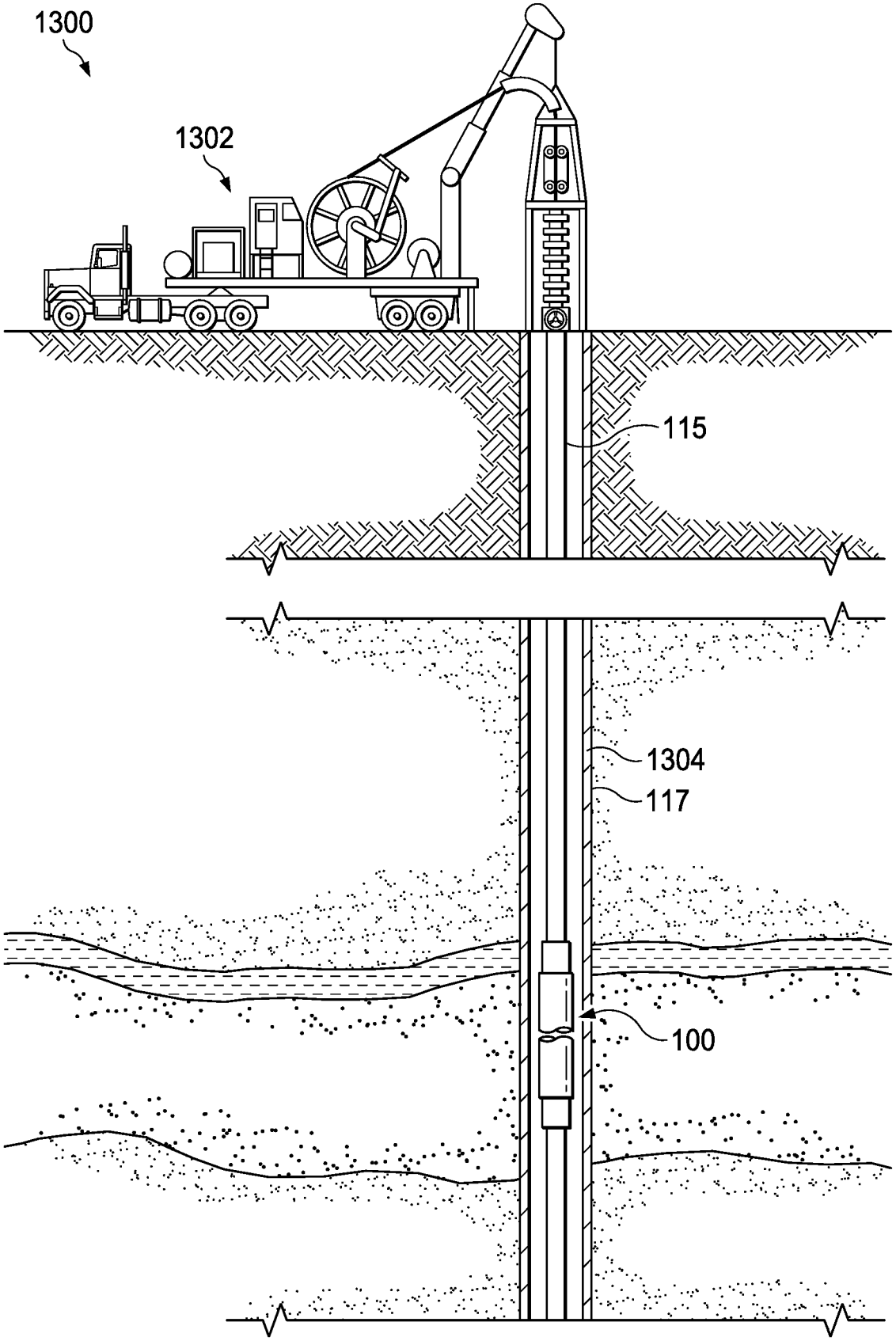

Reference is now made to the following descriptions taken in conjunction with the accompanying drawings, in which:

FIG. 1 presents a cross-sectional view of an example downhole packer ring apparatus of the disclosure;

FIG. 2 presents a cross-sectional view of an alternative example downhole packer ring apparatus of the disclosure;

FIG. 3 presents a cross-sectional view of an another alternative example downhole packer ring apparatus of the disclosure;

FIG. 4 presents a cross-sectional view of an another alternative example downhole packer ring apparatus of the disclosure;

FIG. 5 presents a perspective view of an example downhole packer ring apparatus similar to the embodiment discussed in the context of FIG. 1;

FIG. 6 presents a perspective view of an example downhole packer ring apparatus similar to the embodiment discussed in the context of FIG. 2;

FIG. 7 presents a perspective view of an example downhole packer ring apparatus similar to the embodiment discussed in the context of FIG. 3;

FIG. 8 presents a perspective view of an example downhole packer ring apparatus similar to the embodiment discussed in the context of FIG. 4;

FIGS. 9A and 9B present perspective views of an example downhole packer ring apparatus similar to the embodiment discussed in the context of FIG. 1 or 3, configured as a center ring assembly;

FIGS. 10A and 10B present a perspective views of another example downhole packer ring apparatus similar to the embodiment discussed in the context of FIG. 2 or 4, configured as a center ring assembly;

FIGS. 11A-11E present perspective views of stages of an example first method embodiments of assembling an example downhole packer ring apparatus, such as any of the example apparatuses discussed in the context of FIG. 1, 3, 5, 7 or 9;

FIGS. 12A-12E present perspective views of stages of an example second method embodiment of assembling an example downhole packer ring apparatus of the disclosure, such as any of the example apparatuses discussed in the context of FIG. 2, 4, 6, 8 or 10; and FIG. 13 schematically illustrates a view of a downhole packer ring apparatus of the disclosure implemented in a wellbore.

DETAILED DESCRIPTION

As part of the present invention we recognized that certain packer rings are fastened to a basepipe via a time consuming error prone process, using set screws. Sometimes dozens of set screws per ring are threaded through the ring body to contact the basepipe, with each screw tighten to a predefined torque specification to ensure a uniform gripping force around the basepipe. Consequently, the process of assembling all of the rings to a basepipe can involve tens to hundreds of discrete fastening steps per ring pair and thousands of fastening steps per well. Any of these steps are prone to error, e.g., because a set screw is mistakenly not installed, or not tighten to the correct torque specification.

Embodiments of the ring apparatus disclosed herein mitigate these problems by providing a ring apparatus that can be easily assembled. As we further illustrate in the example embodiments presented below, two ring members of the ring apparatus can be brought together such that tabs of one ring member are flexed to provide a uniform gripping force around the basepipe.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings, with the understanding that they serve as examples and that they do not limit the disclosure to only the illustrated embodiments. Moreover, it is fully recognized that the different teachings of the embodiments discussed, infra, may be employed separately or in any suitable combination to produce desired results.

Unless otherwise specified, any use of any form of the terms such as "press," "connect," "engage," "couple," "attach," or any other term describing an interaction between elements is not meant to limit the interaction to direct interaction between the elements but include indirect interaction between the elements described, as well. In the following discussion and in the claims, the terms "including" and "comprising" are used in an open-ended fashion, and thus should be interpreted to mean "including, but not limited to." Further, any references to "first," "second," etc. do not specify a preferred order of method or importance, unless otherwise specifically stated but are intended to designate separate elements. The various characteristics mentioned above, as well as other features and characteristics described in more detail below, will be readily apparent to those skilled in the art with the aid of this disclosure upon reading the following detailed description of the embodiments, and by referring to the accompanying drawings.

One embodiment of the disclosure is a downhole packer ring apparatus for use in a wellbore. FIG. 1 presents a cross-sectional view of an example downhole packer ring apparatus 100.

The apparatus 100 can comprise a first ring member 102 and a second ring member 104. The first ring member 102 has an end 105 with a plurality of separated end tabs 107 and has an opening 110 with an inner diameter 112 sized to encircle a basepipe 115 of the wellbore 117.

The second ring member 104 has a tapered interior surface 120 and has an end 122 with an opening 124 having an inner diameter 125 sized to encircle the basepipe 115 and connect to the first ring member 102 such that the end tabs 107 of the first ring member 102 are locatable in the end opening 124 of the second ring member 104 and pres sable against the tapered interior surface 120 such that flexed portions 127 of the end tabs 107 engage with the basepipe 115.

As further illustrated in FIG. 1, for some embodiments, a major plane of an outer surface 130 of the flexed portion 127 of each of the end tabs 107, when pressed against the tapered interior surface 120, can form an obtuse angle 132 relative to a major plane of an outer surface 135 of a non-flexed portion 137 of the end tabs 107. However, in other embodiments, the entire tab 107 can be flexed towards the basepipe 115 when the end tabs 107 of the first ring member 102 are moved into the end opening 124 of the second ring member 104.

As further illustrated in FIG. 1, for some embodiments, an opposite end 140 of the first ring member 102 (i.e., the end opposite to the end 105 with end tabs 107) has a straight (i.e., non-tapered) planar outer surface 142 is perpendicular (e.g. the surface 142 forming a substantially right angle 144 of about 90±10 degrees in some embodiments) to a long axis 146 of the basepipe 115 so that a downhole packer rubber element 148 placed around the basepipe 115 lays adjacent to the straight planar outer surface 142. In some such embodiments, an opposite end 150 of the second ring member 104 (e.g., the end opposite to the end 122 with opening 124) includes a tapered outer surface 152.

Those skilled in the pertinent arts would be familiar with materials and methods to configure embodiments of the rubber element to increase in volume to serve as a sealing structure in a wellbore. For instance, some embodiments of the rubber element can swell in response to contact with a particular fluid in the well, or, some embodiments can expand outward, e.g., as in inflatable or compression-set packers, etc.). Those skilled in the pertinent arts would understand how various embodiments of the rubber element could be configured to be pneumatically or hydraulically expandable in that they may be swellable by means of a fluid, or they may be expanded by means of fluid diffusion or inflated by other means.

Having the rubber element 148 lay adjacent to the straight planar outer surface 142 can help mitigate shearing forces that could damage the rubber element 148, e.g., when the rubber element along with the base pipe 115 is run into the wellbore 117.

Having the tapered outer surface 152 on the opposite end 150 of the second ring member 104 can facilitate easy sliding of the apparatus 100 along with the rubber element 148 over the basepipe 115 e.g., by helping to prevent the ring member 104 from getting caught up in the wellbore 117.

FIG. 2 presents a cross-sectional view of an alternative example downhole packer ring apparatus 100 of the disclosure. As illustrated in FIG. 2 the apparatus 100 has features similar to the apparatus 100 shown in FIG. 1, but, is oriented in the opposite manner, in that the second ring member 104 is located nearer to the rubber element 148 than the first ring member 102.

As further illustrated in FIG. 2, to provide similar advantages as already discussed in the context of FIG. 1, in some embodiments, the opposite end 150 of the second ring member 104 of the second ring member has a straight planar outer surface 152 that is perpendicular (e.g. the surface 152 forming a right angle 205 of about 90±10 degrees in some embodiments) to the long axis 146 of the basepipe 115 so that the downhole packer rubber element 148 placed around the basepipe 115 lays adjacent to the straight planar outer surface 152. In some such embodiments, the opposite end 140 of the first ring member 102 includes a tapered outer surface 142.

As further illustrated in FIGS. 1 and 2, in some embodiments, the tapered interior surface 120 of the second ring member 104 can be a planar surface that forms an acute angle 160 relative to the long axis 146 of the basepipe 115. For instance, in some embodiments the angle 160 formed is in a range from about 5 to 45 degrees and in some embodiments about 10 to 30 degrees and in some embodiments about 15 to 25 degrees. The angle 160 may be chosen as a balance between avoiding having too large of a radial flexion of the tabs 107 towards the basepipe (e.g., for steep angles 160 of greater than 45 degrees for some embodiments), versus having too small of a radial flexion of the tabs 107 towards the basepipe (e.g., shallow angles 160 of less than 5 degrees for some embodiments), for given unit of movement of the first and/or second ring members 102, 104 along the long axis 146 of the base pipe 115 to bring the members 102, 104 together.

In other embodiments, however, the tapered interior surface 120 can be a non-planar surface, e.g., such that the surface 120 has a non-linearly changing interior diameter 161 along a distance of the ring member 102 parallel to the long axis 146 of the basepipe 115. For instance, in some embodiments, the interior diameter 161 can vary so as to form a concave, convex or stair-step shaped surface 120 to achieve a variety of different gripping forces of the tabs 107 to the basepipe 115 when the ring members 102, 104 are brought together.

Embodiments of the apparatus 100 can include coupling structures to facilitate bringing the first and second ring members together in a precise and consistent manner. For instance as illustrated in FIGS. 1 and 2, in some embodiments of the apparatus 100, the opposite end 140 of the first ring member 102 includes an exterior surface 162 with pin threads 165 thereon. The end opening 124 of the second ring member 104 includes an interior surface 167 with box threads 170. The box threads 170 can be configured to thread around the pin threads 165 to guide the end 105 with the plurality of separated end tabs 107 into the end opening 124 of the second ring member 104.

For instance, as further disclosed in the context of the method of assembling embodiments below, the box threads 170 can be threaded around the pin threads 165 by rotating the first ring member 102 around the basepipe 115 while the second ring member 104 is fixed in place adjacent to the rubber element 148, such as depicted in FIG. 1, or, the second ring element 104 can be rotated around the basepipe 115 while the first ring member 102 is fixed in place adjacent to the rubber element 148, such as depicted in FIG. 2. One skilled in the pertinent art would appreciate how to adjust a pitch of the pin and box threads 165, 170 to produce a desired longitudinal movement of the first and/or second ring members 102, 104 along the long axis 146 as part of locating the end tabs 107 in the end opening 124 and pressing the tabs 107 against the tapered interior surface 120 to flex the end tabs 107 as previously discussed in the context of FIGS. 1 and 2.

The apparatus can also include locking structures to prevent the ring members from separating from each other and the tabs thereby not being pressed against the tapered interior surface. For instance, as further illustrated in FIGS. 1 and 2, embodiments of the apparatus 100 can further include one or more locking pins 172 configured to pass through aligned openings 174, 176 in the first and second ring members 102, 104, respectively, to hold the first and second ring members 102, 104 together. For instance, the locking pins 172 can be grooved pins (e.g., DRIV-LOK pins, Driv-Lok Inc., Sycamore, Ill.) set screws, bolts or similar structures that can be inserted through the openings 174, 176 to help prevent the ring members 102, 104 from unthreading from each other.

To facilitate firmly grabbing the basepipe, the tabs can further include protrusions. For instance, as illustrated in FIGS. 1 and 2 each of the end tabs 107 can include one or more protrusions 180 configured to engage with the basepipe 115 when the flexed portions 127 of the end tabs 107 press against the tapered interior surface 120. In some embodiments each tab 107 can have a single protrusion 180 while in other embodiments each tab can have two, three or more protrusions 180, e.g., to help distribute a greater grabbing pressure over a larger area around and along the basepipe 115 and mitigate the chance of damaging the basepipe 115. Embodiments of the protrusion 180 can be raised features of the same material that the tabs 107 are constructed of, or, the the protrusion 180 can be separately constructed structures such as set screws or bolts that are located in openings 182 in the tabs 107. In some such embodiments, the protrusions 180 can be introduced into the tabs at preset distance so that ends of the protrusions are close to the basepipe (e.g., millimeters or centimeters away from the basepipe) to facilitate grabbing the basepipe 115 for short longitudinal movements bringing the ring members 102, 104 together.

FIGS. 3 and 4 present cross-sectional views of alternative example embodiments of the downhole packer ring apparatus 100. The apparatus 100 embodiments shown in FIGS. 3 and 4 can have any of the structural features, e.g., first and second ring member 102, 104, end tabs 107, protrusions 180 etc., analogous to the embodiments already discussed in the context of FIGS. 1 and 2, respectively.

As further illustrated in FIGS. 3 and 4, the ring members 102, 104 can further include flaps 310 to facilitate holding the rubber element 148 in place. For instance, as shown in FIG. 3, an opposite end 140 of the first ring member 102, locatable adjacent to a downhole packer rubber element 148, can further include a plurality of separated flaps 310 configured to rest over an end portion 315 of the rubber element 148. Alternatively, as shown in FIG. 4, an opposite end 150 of the second ring member 104, locatable adjacent to the rubber element 148, can further includes a plurality of separated flaps configured to rest over an end portion 315 of the rubber element 148.

In some cases, when the rubber element 148 is increased in volume, e.g., to seal the wellbore 117, the rubber element 148 can undesirably extrude longitudinally into a space (e.g., gap 320) between the ring members 102, 104 and the wellbore 117 and therefore not as efficiently swell radially to seal off the wellbore 117. Having flaps 310 on the end of the ring member that is adjacent to the rubber element 148 can help prevent such longitudinal extrusion. In some such embodiments, the flaps 310 can be configured to be pushed out towards the wellbore 117 when the rubber element 148 increases in volume to thereby expand the outer diameter of the ring member and decrease the extrusion gap 320 and enhance the differential pressure capability of the rubber element 148.

To further illustrate aspects of the apparatus 100 FIGS. 5, 6, 7 and 8 present perspective views of example downhole packer ring apparatuses similar to the embodiment discussed in the context of FIGS. 1, 2, 3 and 4, respectively. For clarity, the ring members 102, 104 are shown separated, that is, prior to bringing the rings members 102, 104 together to locate the end tabs 107 in the end opening 124, and pressed against the tapered interior surface 120, of the second ring member 104.

As illustrated in FIGS. 5-8, the plurality of end tabs 107 can form a collet ring 510 around the end 105 of the first ring member 102 and the tapered interior surface 120 can form an interior wedge-shaped ring 520 of the second ring member 104. For instance, in some embodiments, same-shaped and equally spaced apart tabs 107 can be distributed around the end 105 of the first ring member 102. For instance, in some embodiment the number of tabs 107 forming the collet ring 510 can be in a range from about 4 to 32 separated tabs 107.

As illustrated in FIGS. 7-8 as discussed in the context of FIGS. 3-4, the ring member adjacent to the rubber element 148 (e.g., ring member 102 in FIG. 7 and ring member 104 in FIG. 8) can include a plurality of flaps 310 distributed around the ring member. For instance, in some embodiments, same-shaped and equally spaced apart flaps 310 can be distributed around the opposite end 142 of the first ring member 102 (FIG. 7), or around the opposite end 150 of the second ring member 104 (FIG. 8), to form a flap ring 530 such that the flap ring 530 encircles the end portion 315 of the rubber element 148. For instance, in some embodiment the number of flaps forming the flap ring 530 can be in a range from 4 to 32 separated flaps 310.

In some embodiments, such as any of the downhole packer ring apparatus 100 embodiments discussed in the context of FIGS. 1-8, the apparatus can be part of an end-ring assembly that includes two of the apparatuses situated at either end of a rubber element to hold the rubber element in a place along a base pipe. In other embodiments, the downhole packer ring apparatus can be a center ring assembly situated in-between two different rubber elements along a basepipe.

FIGS. 9A and 9B present perspective views of an example downhole packer ring apparatus 100 configured as a center ring assembly similar to the embodiment discussed in the context of FIG. 1. FIG. 9A presents a view of the apparatus 100 before bringing the first and second ring member 102, 104 together, and, FIG. 9B present a view of after bringing the first and second ring member 102, 104 together and after placing rubber elements 148 around the base pipe 115 such that the apparatus 100 is in-between the rubber elements 148 and thereby configured as a center ring assembly.

As illustrated in FIGS. 9A and 9B, to facilitate serving as a center ring assembly, embodiments of the first ring member 102 of the apparatus 100 can include a second plurality of separated end tabs 907 on the opposite end 140 of the first ring member 102. That is, one end 105 of the first ring member 102 has a first plurality of tabs 107 and the opposite end 140 of the first ring member 102 has a second plurality of tabs 107. As illustrated, the apparatus 100 configured as a center ring assembly, can further include a second one of the second ring member 904. A second plurality of end tabs 907 are locatable in the second one of the second ring member 904 such that the second plurality of end tabs 907 are pressable against the tapered interior surface 920 (analogous to the tapered interior surface 120 of the first one of the second ring member 104) of the second one of the second ring member 904 such that flexed portions (e.g., analogous to the flexed portions 127, FIG. 1) of the second plurality of separated end tabs 907 engage with the basepipe 115.

FIGS. 10A and 10B present perspective views of another example downhole packer ring apparatus 100 configured as center ring assembly similar to the embodiment discussed in the context of FIG. 2. As illustrated in FIGS. 10A and 10B, to facilitate serving as a center ring assembly, embodiments of the second ring member 104 of the apparatus 100 can include a second tapered interior surface 1020 on an opposite end 150 of the second ring member. That is, the second ring member 104 has a second end opening 1024 with an inner diameter (e.g., inner diameter 125, FIG. 1) sized to encircle the basepipe 115 and connect to a second one of the first ring members 1002 such that the end tabs 1007 of the second one of the first ring members 1002 are locatable in the second end opening 1024 of the second ring member 104 and pres sable against the second tapered interior surface 1020 such that flexed portions (analogous to portion 127, FIG. 1) of the end tabs 1007 of the second one of the first ring members 1002 engage with the basepipe 115.

Any of the embodiments of the apparatus 100 configured as a center ring assembly could further include a plurality of separated flaps (e.g., analogous to flaps 310, FIGS. 6-7) configured to rest over ends of the rubber elements that adjacent to the nearest of the ring member 102, 104. For instance, in some such embodiments, outside ends 930, 935 (FIG. 9A) of the first and second ones of the second ring members 104, 904, adjacent to one of the rubber elements 148, respectively, can include a plurality of separated flaps 310 analogous to that depicted for the second ring member 104 shown in FIG. 8, such that the plurality of separated flaps are configured to rest over the end of the respective rubber element 148. Similarly, in some such embodiments, outside ends 1030, 1035 (FIG. 9A) of the first and second ones of the first ring members 102, 1004, adjacent to one of the rubber elements 148, respectively, can include the flaps 310 analogous to that depicted for the first ring member 102 shown in FIG. 7.

Another embodiment of the disclosure is a method of assembling a packer ring apparatus for use in a wellbore.

FIGS. 11A-11E and 12A-12E present perspective views of stages of example first method and second method embodiments, respectively, of assembling an example downhole packer ring apparatus of the disclosure, such as any of the example apparatuses 100 discussed in the context of FIGS. 1-10.

With reference to FIGS. 11A-11B and 12A-12B, embodiments of the method can comprise sliding a first ring member 102 around a basepipe 115 of the wellbore (e.g., wellbore 117, FIGS. 1-4), the first ring member having an end 105 with a plurality of separated end tabs 107. As discussed in the context of FIGS. 1-2, but also applicable to any of the apparatus embodiments shown in FIGS. 3-12E, the first ring member 112 has an opening 110 with an inner diameter 112 sized to encircle the basepipe 115.

The method can also comprise sliding a second ring member 104 around the basepipe. As discussed in the context of FIGS. 1-2, but also applicable to any of the apparatus embodiments shown in FIGS. 3-12E, the second ring member 104 has a tapered interior surface 120, and the second ring member 104 has an end opening 124 with an inner diameter 125 sized to encircle the basepipe 115.

Figure 11A:
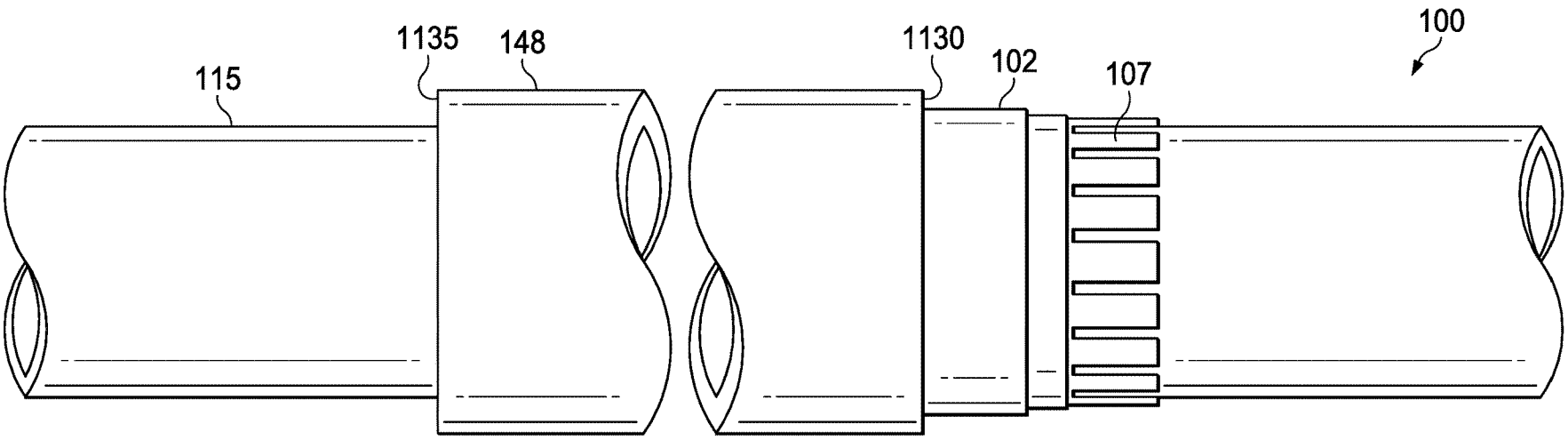
Figure 11B:
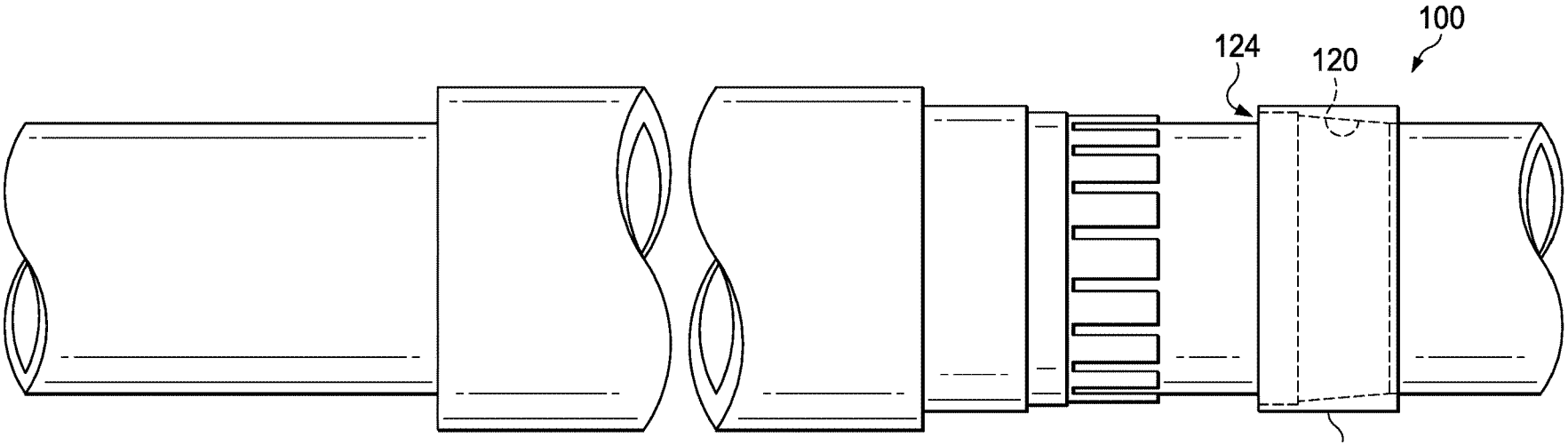

For instance, as illustrated in FIGS. 11A and 11B, in some embodiments of the method, the first ring member 102 can be slid around the basepipe 115 and then the second ring member 104 can be slid around the basepipe 115. For instance, as illustrated in FIGS. 12A and 12B, in alternative embodiments, the second ring member 104 can be slid around the basepipe 115 and then the first ring member 102 can be slid around the basepipe 115.

Figure 11C:
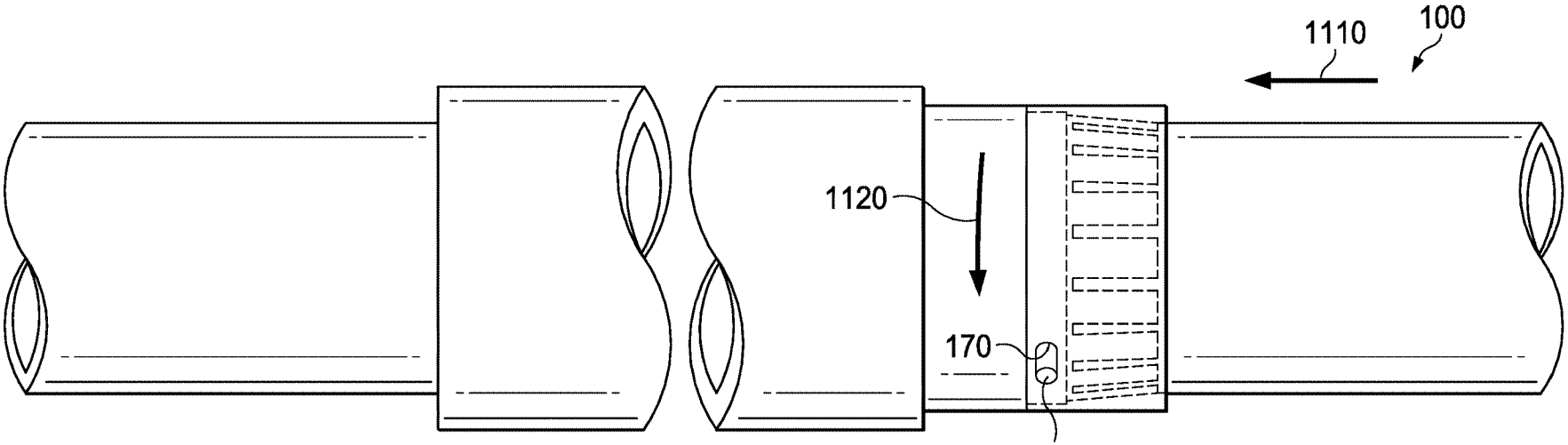

With reference to FIGS. 11C and 12C, embodiments of the method can comprise connecting the first ring member 102 and the second ring member 104 together such that the end tabs 107 of the first ring member are located in the end opening 124 of the second ring member 104 and pressed against the tapered interior surface 120 such that flexed portions 127 (FIGS. 1-2) of the end tabs 107 engage with the basepipe 115.

For instance, as illustrated in FIG. 11C, as part of connecting the first and second ring members 102, 104 together, in some embodiments, the second ring member 104 can be moved along the basepipe 115 (e.g., in direction 1110) towards the first ring member 102 while the first ring member 102 is not moved. For instance, as illustrated in FIG. 12C, as part of connecting the first and second ring members 102, 104 together, in some alternative embodiments, the first ring member 102 can be moved along the basepipe 115 (e.g., in direction 1210) towards the second ring member 104 while the second ring member 104 is not moved.

As illustrated in FIG. 11C, in some embodiments, connecting the first ring member 102 and the second ring member 104 together includes rotating the second ring member 104 around the basepipe 115 (e.g., in direction 1120) while the first ring member 102 is not rotated, the rotating causing the box threads (e.g., box threads 170 on an interior surface 167 of the end opening 124, FIG. 1) of the second ring member 104 to thread around pin threads (e.g., pin threads 165 on an exterior surface 162 of the opposite end 140, FIG. 1) of the first ring member.

Alternatively, as illustrated in FIG. 12C, in some embodiments, connecting the first ring member 102 and the second ring member 104 together includes rotating the first ring member 102 around the basepipe 115 (e.g., in direction 1220) while the second ring member 104 is not rotated, the rotating causing pin threads of the first ring member 102 to thread into box threads of the second ring member 104. In some such embodiments, it may be desirable to minimize the number of rotations required to press the end tabs 107 against the tapered interior surface 120, e.g., to avoid or reduce the flexed portion of the end tabs 127 and/or protrusions 180 from scraping across and damaging the basepipe 115.

As further illustrated in FIGS. 11A-11E or 12A-12E, embodiments of the method can include placing a downhole packer rubber element 148 around the basepipe 115. In some embodiments the rubber element 148 can be placed around the basepipe 115 before one or both of the ring members 102, 104 are slid around the basepipe 115. However, in other embodiments, one or both of the ring members 102, 104 can be slid around the basepipe 115 and then the rubber element can be placed around the basepipe 115.

In some such embodiments, as illustrated in FIG. 11A, a first end 1130 of the rubber element 148 can be place adjacent to a straight outer surface of an opposite end (e.g., straight outer surface 142 of opposite end 140, FIG. 1) of the first ring member 102, the straight outer surface being perpendicular to a long axis of the basepipe (e.g., substantially right angle 144, FIG. 1).

Alternatively, in other embodiments, as illustrated in FIG. 12A, the first end 1130 of the rubber element 148 can be adjacent to a straight outer surface of an opposite end (e.g., straight outer surface 152 of an opposite end 150, FIG. 2) of the second ring member 104, the straight outer surface being perpendicular to a long axis of the basepipe (e.g., substantially right angle 205, FIG. 2).

Figure 11D:
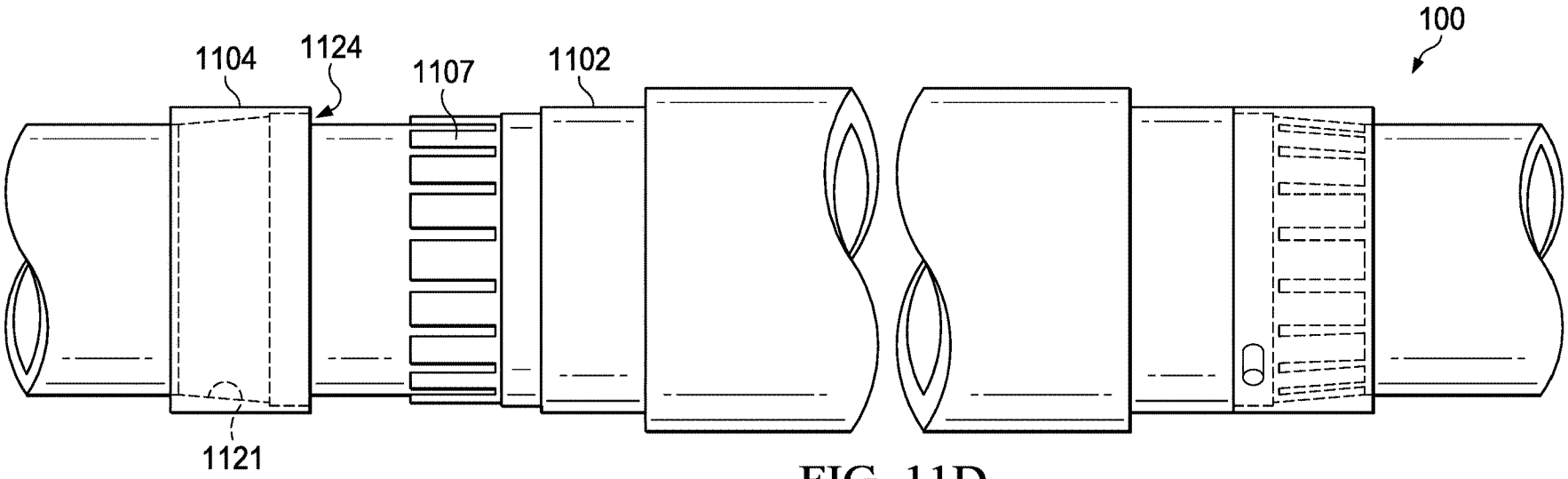

With reference to FIGS. 11D and 12D, embodiments of the method can further include sliding a second one of the first ring member 1102, 1202 around the basepipe 115 and sliding a second one of the second ring member 1104, 1204 around the basepipe 115. As illustrated in FIG. 11D in some embodiments the second one of the first ring member 1102 can be slid around the basepipe 115 and then the second one of the second ring member 1104 can be slid around the basepipe 115. As illustrated in FIG. 12D, in some alternative embodiments, the second one of the second ring member 1204 can be slid around the basepipe 115 and then the second one of the first ring member 1202 can be slid around the basepipe 115.

With reference to FIGS. 11A-11E and 12A-12E, the method can further include connecting the second ones of the first ring member 1102, 1202 and the second ring member 1104, 1204 together such that the end tabs 1107, 1207 of the second one of the first ring member 1202 are located in the end opening 1124, 1224 of the second one of the second ring member 1104, 1204 and pressed against the tapered interior surface 1121, 1221 of the second one of the second ring member 1104, 1204 such that flexed portions of the end tabs (e.g., flex portions 127, FIGS. 1-2) engage with the basepipe 115.

Figure 11E:
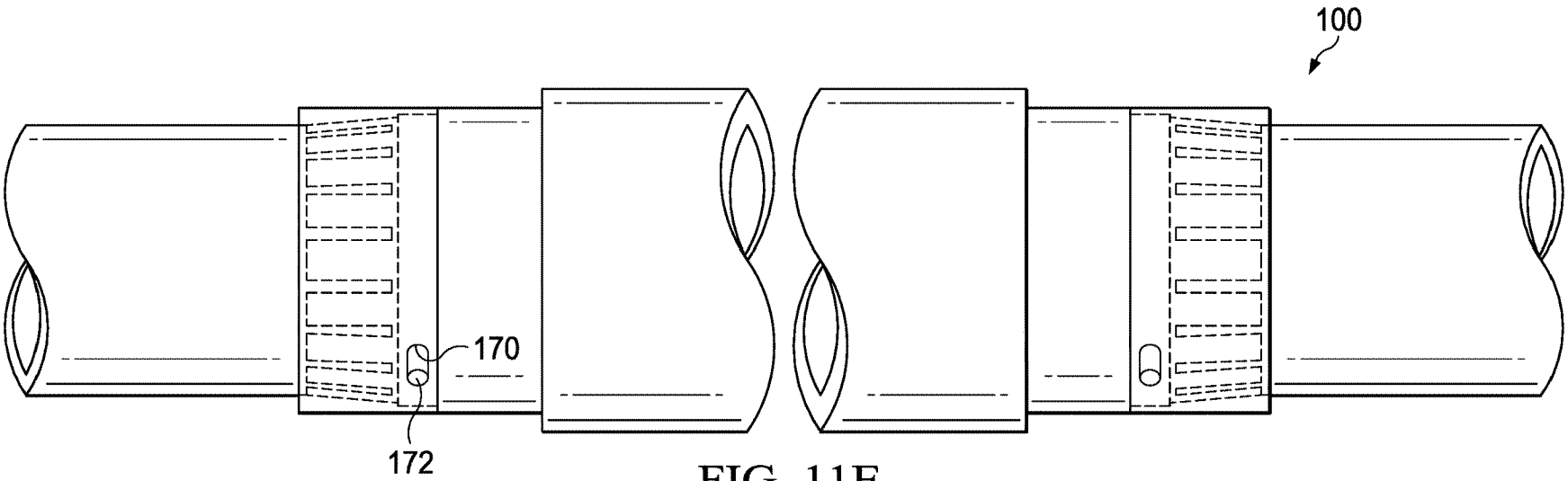

As illustrated in FIGS. 11E and 12E, in some such embodiments, the second ones of the first ring member 1102, 1202 and the second ring member 1104, 1204 are proximate to a second opposite end 1135 of the rubber element 148. For instance, as illustrated in FIG. 11E, the second one of the first ring member 1102 can be adjacent to the second opposite end 1135 of the rubber element 148, or, as illustrated in FIG. 12E, the second one of the second ring member 1104 can be adjacent to the second opposite end 1135 of the rubber element 148.

As illustrated in FIGS. 11C-11E and 12C-12E, some embodiments of the method further include passing one or more locking pins 172 through aligned openings 170 in the first and second ring members 102, 104 to hold the first and second ring members together. Similarly, as further illustrated in FIGS. 11E and 12E, the method can include passing locking pins 172 through aligned openings 170 in the second ones of first and second ring members (e.g., ring members 1102, 1104, or ring members 1202, 1204) to hold the first and second ring members together.

FIG. 13 schematically illustrates a view of a downhole packer ring apparatus 100 of the disclosure implemented in a wellbore 117. FIG. 13 illustrates a system 1300 used to conduct the plugging operations as described above. In one embodiment, the system 100 comprises a workover rig or truck 1302 that supplies a basepipe 115 to which the downhole packer ring apparatus 100, as previously described, is attached. The system 1300 may include a computer for controlling and monitoring the operations of the apparatus 100 during the packing operations. The operator may use a conventional monitoring system to determine when the tool has reached the appropriate depth in the casing 1304 of the wellbore 117. When the appropriate depth is reached, the packing operations to swell the rubber element, as described above, are conducted on one or more plugging zones in the well bore 117.

Those skilled in the art to which this application relates will appreciate that other and further additions, deletions, substitutions and modifications may be made to the described embodiments.

What is claimed is:

1. A downhole packer ring apparatus for use in a wellbore, comprising:

a first ring member having an end with a plurality of separated end tabs that are spaced apart from each other, wherein the first ring member has an opening with an inner diameter sized to encircle a basepipe of the wellbore; and a second ring member having a tapered interior surface, wherein the second ring member has an end with an opening having an inner diameter sized to encircle the basepipe and connect to the first ring member such that the end tabs of the first ring member are locatable in the end opening of the second ring member and pressable against the tapered interior surface such that flexed portions of the end tabs engage with the basepipe, and, the end tabs include protrusions to engage with the basepipe when the flexed portions of the end tabs press against the tapered interior surface.

2. The apparatus of claim 1, wherein a major plane of an outer surface of the flexed portion of each of the end tabs when pressed against the tapered interior surface forms an obtuse angle relative to a major plane of an outer surface a non-flexed portion of the end tabs.

3. The apparatus of claim 1, wherein an opposite end of the first ring member has a straight planar outer surface that is perpendicular to a long axis of the basepipe so that a downhole packer rubber element placed around the basepipe lays adjacent to the straight planar outer surface, and, an opposite end of the second ring member has a tapered outer surface.

4. The apparatus of claim 1, wherein the opposite end of the second ring member has a straight planar outer surface that is perpendicular to a long axis of the basepipe so that a downhole packer rubber element placed around the basepipe lays adjacent to the straight planar outer surface, and, an opposite end of the first ring member has a tapered outer surface.

5. The apparatus of claim 1, wherein the tapered interior surface of the second ring member forms an acute angle relative to a long axis of the basepipe.

6. The apparatus of claim 1, wherein an opposite end of the first ring member includes an exterior surface with pin threads thereon and the end opening of the second ring member includes an interior surface with box threads wherein the box threads to thread around the pin threads to guide the end with the plurality of separated end tabs into the end opening of the second ring member.

7. The apparatus of claim 1, further including one or more locking pins to pass through aligned openings in the first and second ring members to hold the first and second ring members together.

8. The apparatus of claim 1, wherein each of the end tabs includes one or more of the protrusions to engage with the basepipe when the flexed portions of the end tabs press against the tapered interior surface.

9. The apparatus of claim 1, wherein an opposite end of the first ring member locatable adjacent to a downhole packer rubber element further includes a plurality of separated flaps to rest over an end portion of the rubber element.

10. The apparatus of claim 1, wherein an opposite end of the second ring member locatable adjacent to a downhole packer rubber element further includes a plurality of separated flaps to rest over an end portion of the rubber element.

11. The apparatus of claim 1, wherein the plurality of end tabs form a collet ring around the end of the first ring member and the tapered interior surface forms an interior wedge-shaped ring of the second ring member.

12. The apparatus of claim 1, wherein an opposite end of the first ring member has a second plurality of separated end tabs locatable in a second one of the second ring member such that the second plurality of end tabs are pressable against the tapered interior surface of the second one of the second ring members such that flexed portions of the second plurality of separated end tabs engage with the basepipe.

13. The apparatus of claim 1, wherein the second ring member is a first one of the second ring member and the apparatus further includes a second one of the second ring member and an outside end of the first one of the second ring member and an outside end of the second one of the second ring member further include a plurality of separated flaps that are respectively adjacent to different downhole packer rubber elements, the plurality of separated flaps to rest over an end of the respective adjacent rubber element.

14. A downhole packer ring apparatus for use in a wellbore, comprising:

a first ring member having an end with a plurality of separated end tabs, wherein the first ring member has an opening with an inner diameter sized to encircle a basepipe of the wellbore; and a second ring member having a tapered interior surface, wherein the second ring member has an end with an opening having an inner diameter sized to encircle the basepipe and connect to the first ring member such that the end tabs of the first ring member are locatable in the end opening of the second ring member and pressable against the tapered interior surface such that flexed portions of the end tabs engage with the basepipe, wherein an opposite end of the second ring member has a second tapered interior surface, wherein the second ring member has a second end opening with the inner diameter sized to encircle the basepipe and connect to a second one of the first ring members such that the end tabs of the second one of the first ring members are locatable in the second end opening of the second ring member and pressable against the second tapered interior surface such that flexed portions of the end tabs of the second one of the first ring members engage with the basepipe.

15. The apparatus of claim 1, wherein the first ring member is a first one of the first ring member and the apparatus further includes a second one of the first ring member and an outside end of the first one of the first ring member and an outside end of the second one of the first ring member further include a plurality of separated flaps that are respectively adjacent to different downhole packer rubber elements, the plurality of separated flaps to rest over an end of the respective adjacent rubber element.

16. A method of assembling a packer ring apparatus for use in a wellbore, comprising:

sliding a first ring member around a basepipe of the wellbore, the first ring member having an end with a plurality of separated end tabs, wherein the first ring member has an opening with an inner diameter sized to encircle the basepipe;

sliding a second ring member around the basepipe, the second ring member having a tapered interior surface, wherein the second ring member has an end opening with an inner diameter sized to encircle the basepipe;

connecting the first ring member and the second ring member together such that the separated end tabs of the first ring member are located in the end opening of the second ring member and pressed against the tapered interior surface such that flexed portions of the end tabs engage with the basepipe; and then supplying the basepipe and the packer ring apparatus attached thereto to the wellbore.

17. A method of assembling a packer ring apparatus for use in a wellbore, comprising:

sliding a first ring member around a basepipe of the wellbore, the first ring member having an end with a plurality of separated end tabs, wherein the first ring member has an opening with an inner diameter sized to encircle the basepipe;

sliding a second ring member around the basepipe, the second ring member having a tapered interior surface, wherein the second ring member has an end opening with an inner diameter sized to encircle the basepipe; and connecting the first ring member and the second ring member together such that the separated end tabs of the first ring member are located in the end opening of the second ring member and pressed against the tapered interior surface such that flexed portions of the end tabs engage with the basepipe, wherein connecting the first ring member and the second ring member together includes rotating the second ring member around the basepipe while the first ring member is not rotated, the rotating causing box threads of the second ring member to thread around pin threads of the first ring member.

18. The method of claim 16, further including placing a downhole packer rubber element around the basepipe, wherein:

a first end of the rubber element is adjacent to a straight outer surface of an opposite end of the first ring member, the straight outer surface being perpendicular to a long axis of the basepipe, or, the first end of the rubber element is adjacent to a straight outer surface of an opposite end of the second ring member, the straight outer surface being perpendicular to a long axis of the basepipe.

19. The method of claim 18, further including:

sliding a second one of the first ring member around the basepipe;

sliding a second one of the second ring member around the basepipe; and connecting the second ones of the first ring member and the second ring member together such that the end tabs of the second one of the first ring member are located in the end opening of the second one of the second ring member and pressed against the tapered interior surface of the second ring member such that flexed portions of the end tabs engage with the basepipe, wherein:

the second ones of the first ring member and the second ring member are proximate to a second opposite end of the rubber element.

20. The method claim 16, further including passing one or more locking pins through aligned openings in the first and second ring member to hold the first and second ring members together.

* * * * *